US006810853B1

(12) United States Patent
Wong et al.

(10) Patent No.: US 6,810,853 B1
(45) Date of Patent: Nov. 2, 2004

(54) ELECTRONIC THROTTLE CONTROL (ETC) IDLE AREA REQUEST SECURITY

(75) Inventors: Kevin C. Wong, Ann Arbor, MI (US); Paul A. Bauerle, Fenton, MI (US); Todd R. Shupe, Milford, MI (US); Edward J. Tully, Royal Oak, MI (US); Kerfegar K. Katrak, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/685,324

(22) Filed: Oct. 14, 2003

(51) Int. Cl.[7] ..... F02D 41/00
(52) U.S. Cl. ..... 123/339.14; 123/339.1
(58) Field of Search ..... 123/339.1, 339.14, 123/339.16, 339.17, 339.18, 339

(56) References Cited

U.S. PATENT DOCUMENTS 5,666,917 A * 9/1997 Fraser et al. ..... 123/339.11
6,062,196 A * 5/2000 Haboldt ..... 123/339.16

* cited by examiner

*Primary Examiner*—Bibhu Mohanty
(74) *Attorney, Agent, or Firm*—Christopher DeVries

(57) ABSTRACT

An electronic throttle control (ETC) system to control an idle speed of an engine includes an accessory that increases a load on the engine and a controller that generates an idle request signal based on the increased load. The controller compares the idle request signal to an idle maximum signal and sets an idle command signal equal to the idle request signal if the idle request signal is less than the idle maximum signal. The controller determines the idle command signal based on the idle request signal, a previous idle command signal and the idle maximum increase signal if the idle request signal is greater than the idle maximum signal.

19 Claims, 2 Drawing Sheets

ELECTRONIC THROTTLE CONTROL (ETC) IDLE AREA REQUEST SECURITY

FIELD OF THE INVENTION

The present invention relates to electronic throttle control (ETC), and more particularly to an idle area request security control for ETC.

BACKGROUND OF THE INVENTION

Historically, a throttle of an engine has been mechanically manipulated by a throttle cable, which interconnects the throttle and an accelerator pedal. As the accelerator pedal is depressed, the cable opens the throttle and increases engine torque output. More recently, the mechanical cable system has been replaced by an electronic throttle control (ETC) system. The ETC system includes electronic control modules, sensors and actuators and is also referred to as 'Fly-by-Wire'.

There are several advantages in implementing an ETC over a conventional throttle cable. The use of the ETC system ensures that the engine receives the correct amount of throttle opening for any given situation. The optimization of air flow also ensures that exhaust emissions are kept to an absolute minimum and drivability is maintained. Coupling the electronic throttle actuation to adaptive cruise control, traction control, idle speed control and vehicle stability control systems also provides finer control. Other advantages include eliminating mechanical components of the throttle cable. This reduces the number of moving parts (and associated wear) and minimizes adjustment and maintenance. Further, increased control accuracy improves vehicle drivability, which in turn provides better response and fuel economy.

Although the ETC system includes these advantages, further development of the ETC system and control logic for controlling the ETC system is required. This is particularly true for controlling the ETC system at higher engine speeds.

SUMMARY OF THE INVENTION

Accordingly, the present invention provides an electronic throttle control (ETC) system to control an idle speed of an engine. The ETC system includes an accessory that increases a load on the engine and a controller that generates an idle request signal based on the increased load. The controller compares the idle request signal to an idle maximum signal and sets an idle command signal equal to the idle request signal if the idle request signal is less than the idle maximum signal. The controller determines the idle command signal based on the idle request signal, a previous idle command signal and the idle maximum increase signal if the idle request signal is greater than the idle maximum signal.

In one feature, the controller sets the idle maximum increase signal equal to an idle speed increase signal.

In another feature, the controller sets the idle command signal equal to a minimum of the idle request signal and a maximum between said idle maximum signal and a sum of the previous idle command signal and the idle maximum increase signal.

In still another feature, the controller compares the idle command signal to an idle brake maximum signal. The controller sets the idle command signal equal to the idle brake maximum signal if the idle command signal is greater than the idle brake maximum signal.

In yet another feature, the controller operates the engine based on the idle command signal.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
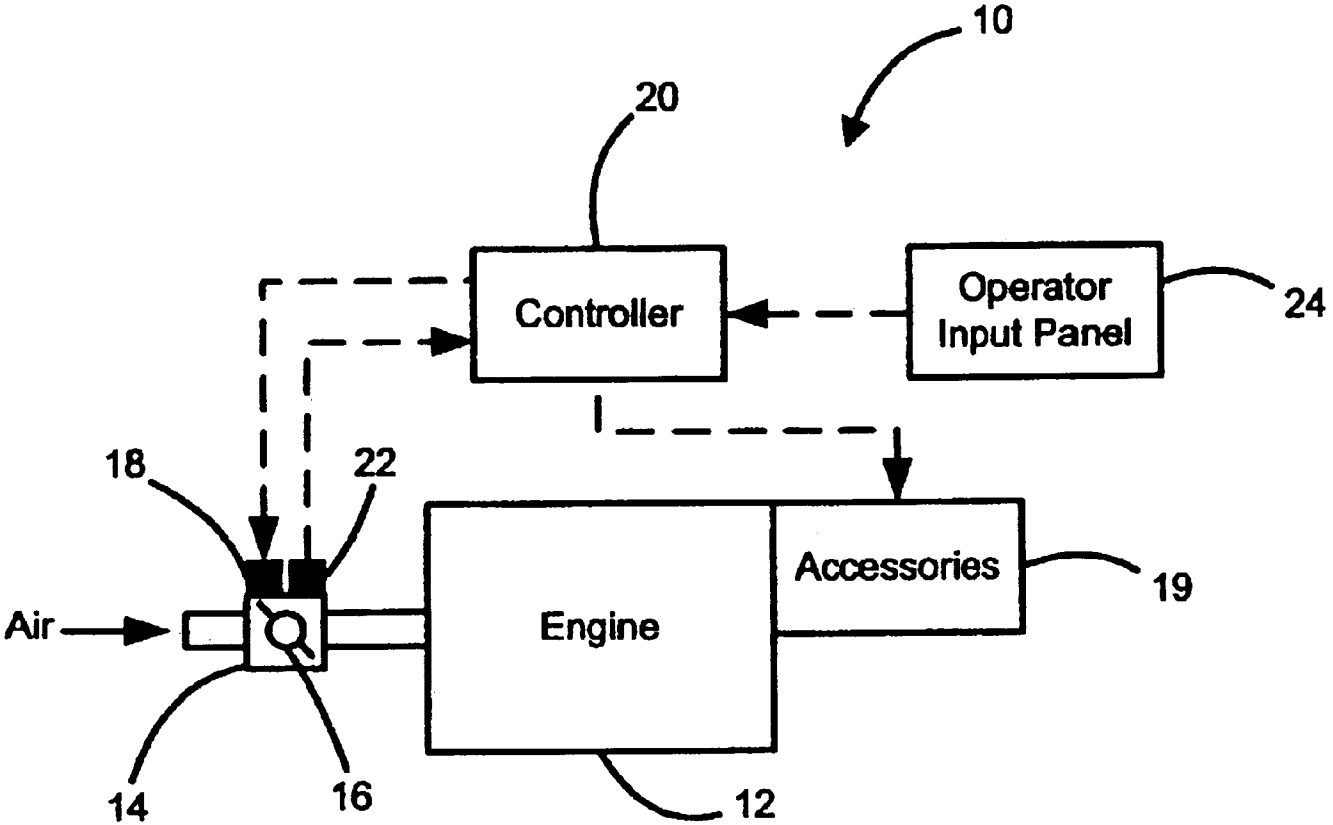
FIG. 1 is a functional block diagram am of an exemplary vehicle incorporating the electronic throttle control (ETC) idle control according to the present invention.

The following description of the preferred embodiment is merely exemplary in nature and is in no way intended to limit the invention, its application, or uses. For purposes of clarity, the same reference numbers will be used in the drawings to identify similar elements.

Referring now to FIG. 1, a vehicle 10 is schematically illustrated and includes an engine 12. Air is mixed with fuel and combusted inside the engine 12 to produce drive torque. Air is drawn into the engine 12 through a throttle 14. The throttle 14 includes a throttle plate 16 that is controlled by an actuator 18. The position of the throttle plate 16 defines a throttle area through which air flows. As the throttle plate position changes, the throttle area changes to meter the air flow into the engine 12.

The engine 12 produces drive torque to drive wheels (not shown) through a transmission (not shown). Some of the drive torque is used to drive accessories 19. Exemplary accessories include an alternator that produces electrical energy for charging a battery (not shown), a compressor associated with an HVAC system and a pump that provides pressurized fluid to other vehicle systems including the transmission.

A controller 20 controls overall engine operation based on control algorithms and driver inputs. The controller 20 communicates with the actuator 18 to control the position of the throttle plate 16 and with a throttle position sensor 22 to monitor the position of the throttle plate 16. An operator input panel 24 enables an operator to activate any one of several devices associated with the vehicle 10. For example, the operator can activate the HVAC system or electronic devices, such as the radio, lights, seat heaters, defoggers and the like. Activation of these devices impacts engine torque output. For example, activation of the HVAC system causes the compressor to be driven by the engine 12, thereby decreasing engine torque output. Similarly, activation of electronic devices drains the battery which is recharged by the alternator being driven by the engine 12. This again results in decreased torque output.

During engine idle, the controller 20 regulates the throttle 14 to maintain an idle speed of the engine 12. The controller 20 adjusts the idle speed to compensate for engine torque loss used to drive any of the accessories 19. Without compensation, the engine speed would lower to a point of rough engine operation or engine stall. The controller 20 adjusts the idle speed based on a throttle area idle request ($A_{idlereq}$). $A_{idlereq}$ is generated by the controller 20 based on idle control logic. The idle control logic determines $A_{idlereq}$ based on the engine drive torque requirements during engine idle (e.g., drive torque required to drive accessories). The controller 20 processes the ETC idle control to determine a throttle area idle command ($A_{idelcom}$) based on $A_{idlereq}$. The controller 20 signals the actuator 18 to actuate the throttle plate 16 to achieve $A_{idlecom}$.

Figure 2:
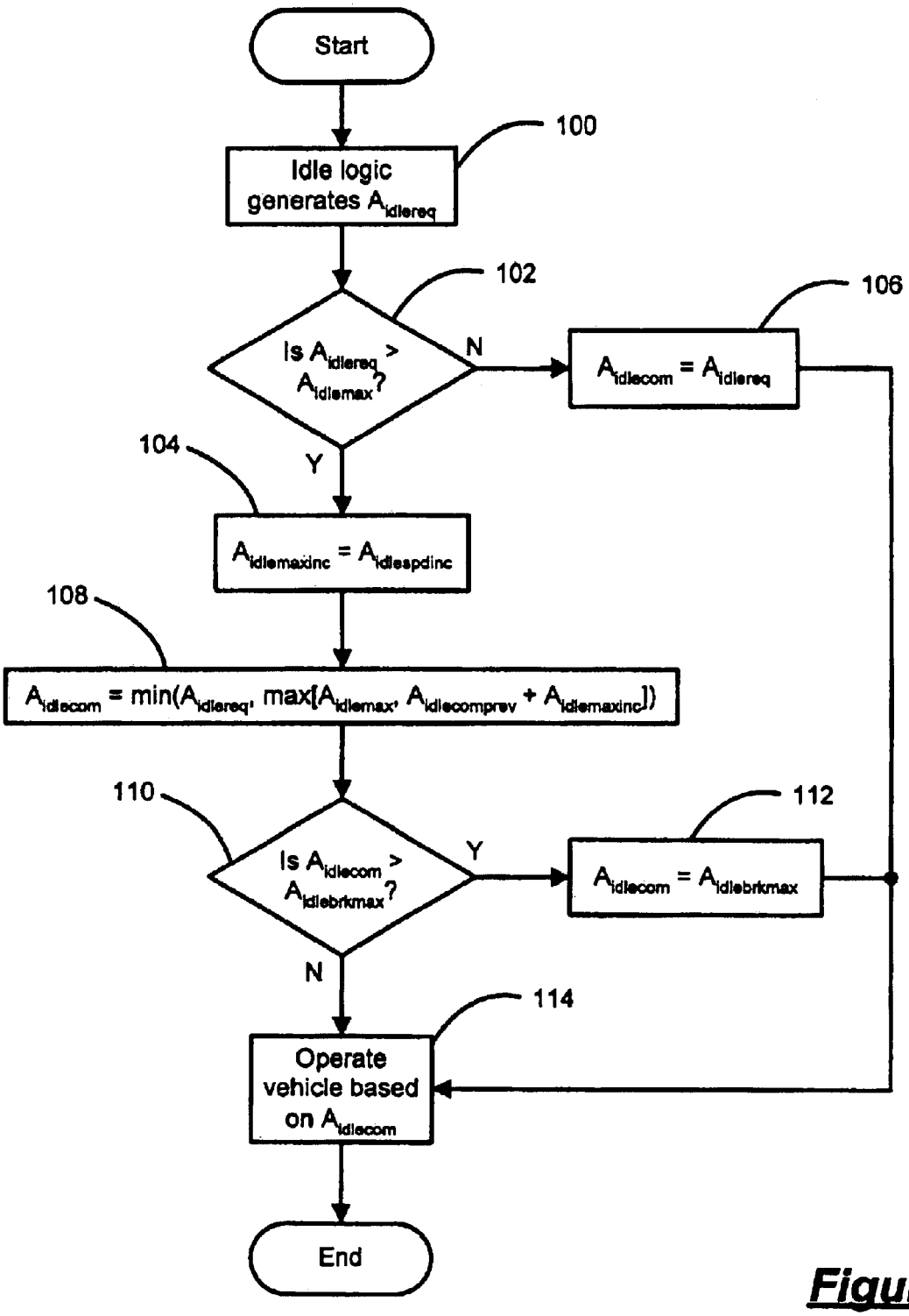
FIG. 2 is a flowchart illustrating the ETC idle control according to the present invention.

Referring now to FIG. 2, the ETC idle control will be described in detail. In step 100, control generates $A_{idlereq}$. Control compares $A_{idlereq}$ to a maximum idle throttle area ($A_{idlemax}$) in step 102. $A_{idlemax}$ is a threshold value, above which $A_{idlecom}$ is limited to ensure comfortable vehicle operation. If $A_{idlereq}$ is greater than $A_{idlemax}$, control continues in step 104. Otherwise, control continues in step 106.

In step 104, control sets an idle area maximum increase ($A_{idlemaxinc}$) equal to an idle area engine speed increase ($A_{idlespdinc}$). $A_{idlespdinc}$ is determined from a look-up table on engine speed (RPM) or engine torque and transmission gear or axle torque. $A_{idlemaxinc}$ provides a maximum amount by which the throttle area can increase to prevent over-acceleration of the engine speed during idle. In step 108, control calculates $A_{idlecom}$ as the minimum of $A_{idlereq}$ and the maximum between $A_{idlemax}$ and the sum of a previous idle area command ($A_{idlecomprev}$) and $A_{idlemaxinc}$. This is provided as:

$$A_{idlecom}=\min(A_{idlereq}, \max[A_{idlemax}, A_{idlecomprev}+A_{idlemaxinc})$$

Control compares $A_{idlecom}$ to a throttle area idle brake maximum ($A_{idlebrkmax}$) in step 110. $A_{idlebrkmax}$ is the maximum idle throttle area allowed such that the vehicle 10 can be braked to a stop. For example, in the case of a vehicle having an automatic transmission and that is coasting with the engine at idle, if the engine idle speed is too high, the engine drive torque is sufficient to drive the transmission through the torque converter. If $A_{idlecom}$ is greater than $A_{idlebrkmax}$, control continues in step 112. Otherwise control continues in step 114.

In step 106, control sets $A_{idlecom}$ equal to $A_{idlereq}$ and control continues in step 114. In step 112, control sets $A_{idlecom}$ equal to $A_{idlebrkmax}$ and control continues in step 114. Control operates the vehicle based on $A_{idlecom}$ in step 114.

The ETC idle control of the present invention ensures that the requested idle speed is secure. More particularly, the ETC idle control limits the idle request to a maximum idle speed to ensure the engine does not rev too high during idle. Further, the ETC idle control monitors the requested idle speed to ensure there is not too rapid of an increase in idle speed, surprising the operator. Finally, the ETC idle control limits the idle request to facilitate braking of the vehicle as it coasts while in idle.

Those skilled in the art can now appreciate from the foregoing description that the broad teachings of the current invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An electronic throttle control (ETC) system to control an idle speed of an engine, comprising:

an accessory that increases a load on said engine; and a controller that generates an idle request signal based on said increased load, that compares said idle request signal to an idle maximum signal, that sets an idle command signal equal to said idle request signal if the idle request signal is less than said idle maximum signal, and that determines said idle command signal based on said idle request signal, a previous idle command signal and the idle maximum increase signal if said idle request signal is greater than said idle maximum signal.

2. The ETC system of claim 1 wherein said controller sets said idle maximum increase signal equal to an idle speed increase signal.

3. The ETC system of claim 1 wherein said controller sets said idle command signal equal to a minimum of said idle request signal and a maximum between said idle maximum signal and a sum of said previous idle command signal and said idle maximum increase signal.

4. The ETC system of claim 1 wherein said controller compares said idle command signal to an idle brake maximum signal.

5. The ETC system of claim 4 wherein said controller sets said idle command signal equal to said idle brake maximum signal if said idle command signal is greater than said idle brake maximum signal.

6. The ETC system of claim 1 wherein said controller operates said engine based on said idle command signal.

7. A method of controlling an idle speed of an engine, comprising:

comparing an idle request signal to an idle maximum signal;

setting an idle command signal equal to an idle request signal if said idle request signal is less than said idle maximum signal; and determining said idle command signal based on said idle request signal, a previous idle command signal and an idle maximum increase signal if said idle request signal is greater than said idle maximum signal.

8. The method of claim 7 further comprising generating said idle request signal.

9. The method of claim 7 further comprising setting said idle maximum increase signal equal to an idle speed increase signal.

10. The method of claim 7 wherein said step of determining said idle command signal based on said idle request signal, said previous idle command signal and said idle maximum increase signal comprises setting said idle command signal equal to a minimum of said idle request signal and a maximum between said idle maximum signal and a sum of said previous idle command signal and said idle maximum increase signal.

11. The method of claim 7 further comprising comparing said idle command signal to an idle brake maximum signal.

12. The method of claim 11 further comprising setting said idle command signal equal to said idle brake maximum signal if said idle command signal is greater than said idle brake maximum signal.

13. The method of claim 7 further comprising operating said engine based on said idle command signal.

14. A method of operating an engine at idle, comprising:

generating an idle request signal;

setting said idle command signal equal to an idle request signal if said idle request signal is less than said idle maximum signal;

determining said idle command signal based on said idle request signal, a previous idle command signal and an idle maximum increase signal if said idle request signal is greater than said idle maximum signal; and operating said engine based on said idle command signal.

15. The method of claim 14 further comprising setting said idle maximum increase signal equal to an idle speed increase signal.

16. The method of claim 14 wherein said step of determining said idle command signal based on said idle request signal, said previous idle command signal and said idle maximum increase signal comprises setting said idle command signal equal to a minimum of said idle request signal and a maximum between said idle maximum signal and a sum of said previous idle command signal and said idle maximum increase signal.

17. The method of claim 14 further comprising comparing said idle command signal to an idle brake maximum signal.

18. The method of claim 17 further comprising setting said idle command signal equal to said idle brake maximum signal if said idle command signal is greater than said idle brake maximum signal.

19. The method of claim 14 further comprising operating said engine based on said idle command signal.

* * * * *